US011812830B2

(12) United States Patent
Thompson-Pope

(10) Patent No.: US 11,812,830 B2
(45) Date of Patent: Nov. 14, 2023

(54) AUTOMOBILE DOCUMENT CASE

(71) Applicant: Susan Diane Thompson-Pope, Bath, MI (US)

(72) Inventor: Susan Diane Thompson-Pope, Bath, MI (US)

( * ) Notice: Subject to any disclaimer, the term of this patent is extended or adjusted under 35 U.S.C. 154(b) by 0 days.

(21) Appl. No.: 16/974,426

(22) Filed: Jan. 28, 2021

(65) Prior Publication Data

US 2022/0232937 A1 Jul. 28, 2022

(51) Int. Cl.

*A45C 11/00* (2006.01)
*A45C 13/10* (2006.01)
*B68F 1/00* (2006.01)

(52) U.S. Cl.

CPC ..... *A45C 11/00* (2013.01); *A45C 13/1076* (2013.01); *B68F 1/00* (2013.01)

(58) Field of Classification Search

CPC ..... A45C 11/00; A45C 13/1076; A45C 15/00; B68F 1/00
USPC ..... 206/38, 459.5
See application file for complete search history.

(56) References Cited

U.S. PATENT DOCUMENTS 4,465,179 A * 8/1984 Miller ..... A45C 11/16 206/37
4,645,077 A * 2/1987 McLaughlin ..... A45F 5/00 206/215
4,726,126 A * 2/1988 Bernhard ..... A43B 7/20 36/89
5,941,375 A * 8/1999 Kamens ..... A45C 11/182 206/38
6,149,003 A * 11/2000 Day ..... A45C 11/182 150/150
6,263,885 B1 * 7/2001 Levy ..... A44C 5/0053 132/273
8,496,106 B1 * 7/2013 Bigg ..... A45C 11/00 206/38
8,590,698 B1 * 11/2013 Osborne ..... A45F 5/021 206/5
2003/0213826 A1 * 11/2003 Jacobs ..... A45C 11/182 224/610
2005/0133130 A1 * 6/2005 Blum ..... A45F 5/00 150/149
2012/0261293 A1 * 10/2012 Villarrubia ..... B32B 15/09 206/459.5
2013/0318922 A1 * 12/2013 Lloyd ..... A61M 16/0672 383/105
2018/0220757 A1 * 8/2018 Brundage ..... A45C 13/103
(Continued)

FOREIGN PATENT DOCUMENTS

WO WO-2008070073 A2 * 6/2008 ..... A45C 11/32

*Primary Examiner* — Rafael A Ortiz
(74) *Attorney, Agent, or Firm* — The Keys Law Firm PLLC

(57) ABSTRACT

Safer Stops is a 4.5"×4.5" octagonal case mounted on the steering cowl used to house driving documents requested during a typical traffic stop to prevent the drivers hands from leaving site of the police officer. Safer Stops consist of two octagonal pieces of leather sewn together on five connecting sides of the eight. The three sides not sewn together form an opening which is secured with a snap closure. On the back is a 3' round sticky re-useable gel pad. One Side of the gel pad sticks to the case the other side sticks to the steering cowl. The device comes in many colors and is branded with the Safer Stops logo.

3 Claims, 2 Drawing Sheets

Safer Stops Drawing Front

Safer Stops Drawing Back

(56) References Cited

U.S. PATENT DOCUMENTS

| | | | | |
|---|---|---|---|---|
| 2019/0008256 | A1* | 1/2019 | Basham | A45C 15/00 |
| 2019/0322441 | A1* | 10/2019 | Rosenberg | B65D 81/3897 |
| 2020/0170456 | A1* | 6/2020 | Johnson | A47K 3/38 |
| 2020/0405023 | A1* | 12/2020 | Cook | A45C 11/008 |
| 2021/0007929 | A1* | 1/2021 | Beader | A61J 7/0015 |

* cited by examiner

Safer Stops Drawing Front

Safer Stops Drawing Back

AUTOMOBILE DOCUMENT CASE

FIELD OF INVENTION

Driver Safety

BACKGROUND

The background of the Safer Stops case is it Is a driver safety product.

Summary

The Safer Stops case is designed to hold the documents requested in a routine traffic stop, (license, proof of insurance and vehicle registration, thus making it unnecessary to reach in pockets, glove compartments or purses to retrieve required documents.

Safer Stops is mounted on the steering cowl therefore drivers can keep their hands on the steering wheel and in view of the officer.

The Safer Stops case was developed to keep drivers safer during traffic stops.

A) A Written Description of Invention

The Safer Stops case is two pieces of 4.5"×4.5" leather octagonal pieces sewn together on five of the eight sides.

The case is ¼ in thick.

The case has one snap closure on the top.

The case is adapted to be mounted on the car with a silicon gel pad which allows it to adhere to the steering column cowl of any motor vehicle.

The words 'Safer Stop Safer" are printed or embossed on the front.

The case comes in a variety of colors.

B) The Manner and Process of Making the Invention

Safer Stops case is die cut in a octagon shape.

It is sewn together on five sides and open on the top 3 edges.

The device is then printed or embossed.

Finally a snap is installed on the top edge of the case.

C) The Best Mode Contemplated By the Inventor of Carrying Out Invention

The Safer Stops device is mass produced in a cut and sew facility and will be marketed to the public via online sales.

D) BACKGROUND OF THE INVENTION

The background of the Safer Stops case is safety. Safety for all drivers. This is why I developed it. Safety For my family and yours

FIG. 1

DESCRIPTION OF DRAWINGS SAFER STOPS DRAWING FRONT

Shows front of Safer Stops case
Shows front of snap closure

Figure 1:
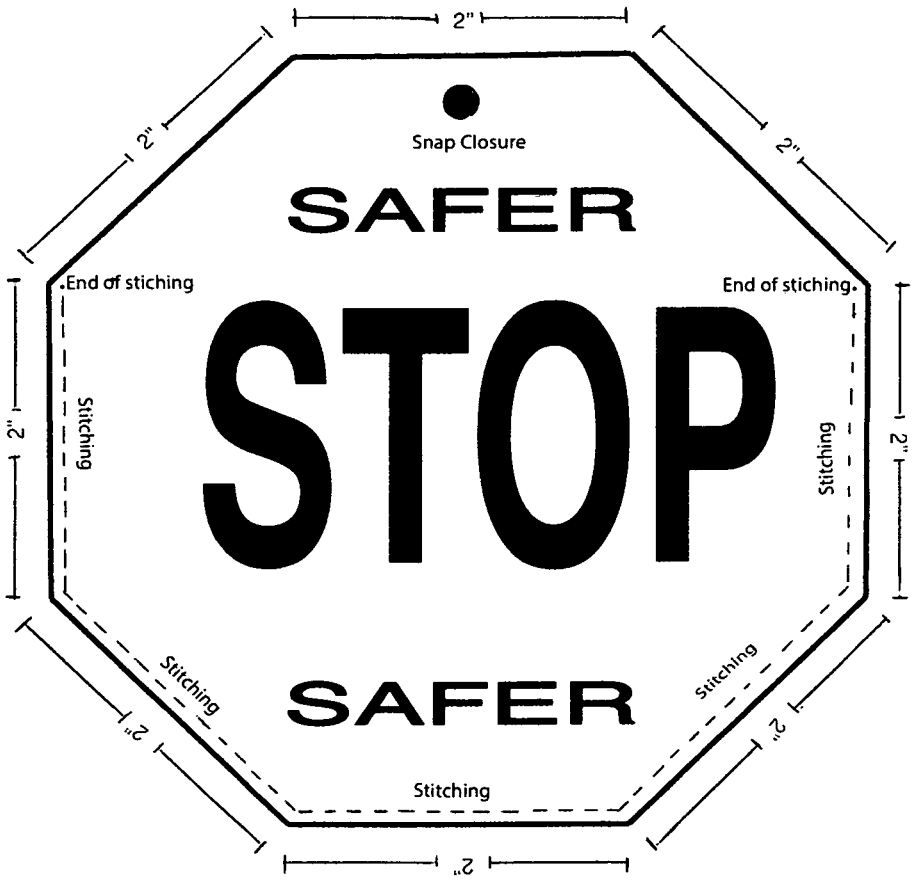
Figure 1A:
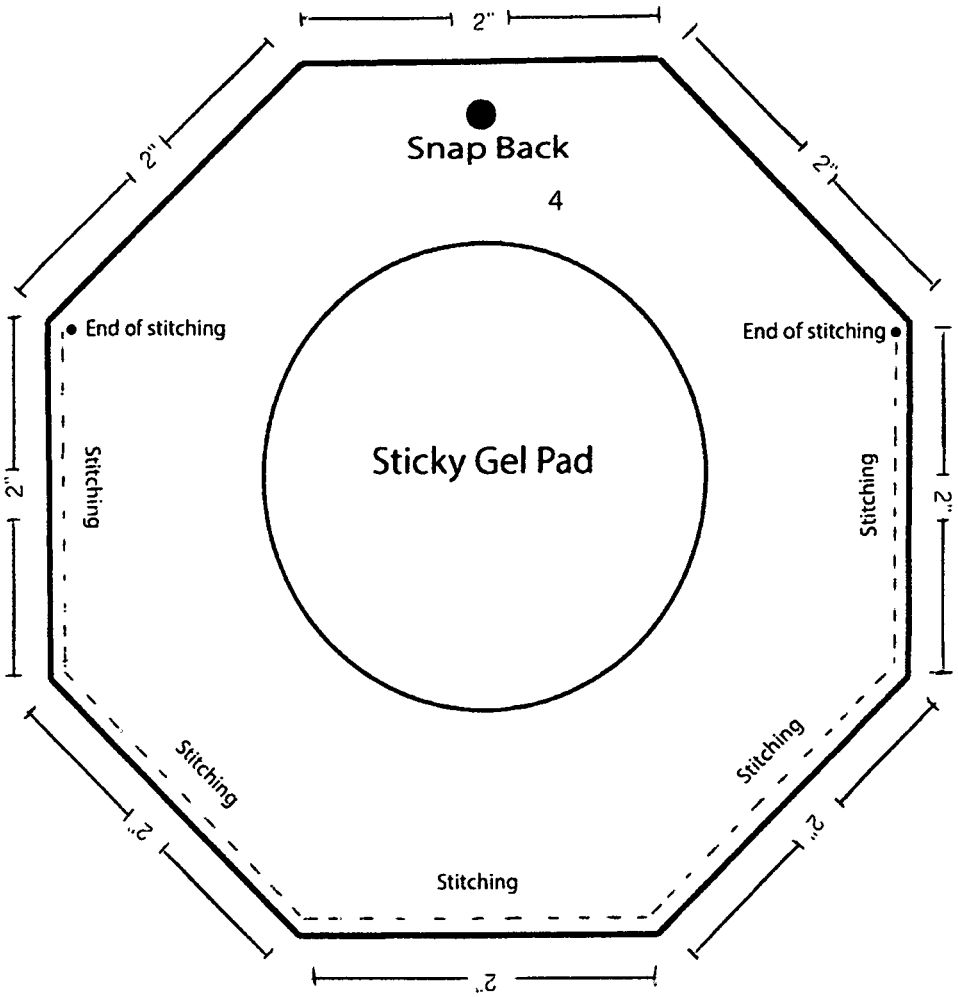

Shows where stitching ends to allow for opening
Shows where stitching is located
Shows where all print/decoration is located
Shows measurement of each side
FIG. 1A

DESCRIPTION OF DRAWINGS SAFER STOPS DRAWING BACK

Shows back of snap closure
Shows where stitching ends to allow for opening
Shows where stitching is located
Shows location of gel pad that holds case in place
Shows measurement of each octagon side

The invention claimed is:

1. A case for keeping a driver and a police officer safer during an encounter between the driver and the police officer, the case comprising:

a discrete, octagonal first piece having eight sides, wherein the first piece is fabricated from leather and each side of the first piece has the same length as the other sides of the first piece;

a discrete, octagonal second piece having eight sides, wherein the second piece is fabricated from leather and each side of the second piece has the same length as the other sides of the second piece as well as of each side of the first piece;

wherein the first piece and the second piece are oriented such that each side of the first piece amongst the eight sides of the first piece is aligned with one corresponding side of the second piece which is amongst the eight sides of the second piece;

wherein the first piece and the second piece are sewn together with stitching which is continuous and extends completely across more than half of the sides of the first piece and of the second piece but less than all of the sides of the first piece and of the second piece;

wherein the first piece and the second piece each include a portion of a snap closure, with the portion of the snap closure on the first piece positioned adjacent to one of the sides of the first piece which does not have stitching adjacent to it and the portion of the snap closure on the second piece positioned on the side of the second piece which is the corresponding side relative to the side of the first piece having the portion of the snap closure;

wherein the second piece includes a sticky pad constructed of silicone gel; and wherein the case is sized to hold at least a driver's license and indicia of "Safer Stop Safer" disposed on the first piece.

2. The case of claim 1 wherein the first piece and the second piece are sewn together with stitching which extends completely across five of the sides of the first piece and of the second piece.

3. The case of claim 1 wherein an exterior size of the case is 4.5 inches by 4.5 inches.

* * * * *